US005688340A

United States Patent [19]

Fleischhacker-Jeworrek et al.

[11] Patent Number: 5,688,340

[45] Date of Patent: Nov. 18, 1997

[54] PREPARATION OF METAL SURFACES FOR VITREOUS ENAMELING

[75] Inventors: Margit Fleischhacker-Jeworrek, Usingen; Dieter Jentsch, Wardenburg/Achternmeer; Klaus Wittel, Frankfurt, all of Germany

[73] Assignee: Metallgesellschaft Aktiengesellschaft, Frankfurt, Germany

[21] Appl. No.: 517,816

[22] Filed: Aug. 22, 1995

[30] Foreign Application Priority Data

Aug. 24, 1994 [DE] Germany ..... 44 29 936.2

[51] Int. Cl.[6] ..... C23C 22/08

[52] U.S. Cl. ..... 148/261; 148/262

[58] Field of Search ..... 148/261, 262

[56] References Cited

U.S. PATENT DOCUMENTS 4,264,378 4/1981 Oppen et al. ..... 148/6.15 R

FOREIGN PATENT DOCUMENTS 0015020 9/1980 European Pat. Off. ..... C23F 7/08

2286889 4/1976 France ..... C23F 7/10

1498490 1/1978 United Kingdom ..... C23F 7/10

2182679 5/1987 United Kingdom ..... C23C 22/07

2259920 3/1993 United Kingdom ..... C23C 22/42

*Primary Examiner*—Sam Silverberg

*Attorney, Agent, or Firm*—Felfe & Lynch

[57] ABSTRACT

Disclosed is a process in which a phosphate layer is formed on a metal surface in preparation for the subsequent application of a vitreous enamel coating, wherein a phosphating solution is used which contains essentially nickel and/or cobalt as a layer-forming cation in amounts of 0.5 to 3 g/l as well as 5 to 20 g/l phosphate (calculated as $P_2O_5$), 0.1 to 0.5 g/l molybdate (calculated as $MoO_3$), 0.2 to 2 g/l fluoride (calculated as F), 1 to 10 g/l nitrate (calculated as $NO_3$), and optionally also 0.1 to 5 g/l urea.

It is particularly desirable to use essentially zinc-free phosphating solutions at temperatures preferably of 60° to 70° C. for 2 to 12 minutes to form a phosphate layer having a coating weight of 1.0 to 2.0 g/m$^2$.

10 Claims, No Drawings

PREPARATION OF METAL SURFACES FOR VITREOUS ENAMELING

BACKGROUND OF INVENTION

This invention relates to a process for the preparation of metal surfaces for a subsequent vitreous enameling by application of a phosphate coating by means of a phosphating solution containing layer-forming cations, phosphate, nitrate and fluoride.

It is known that metal surfaces to be provided with a vitreous enamel coating may be subjected to an expensive sequence of process steps before the enamel is finally applied. The workpiece to be treated usually consists of high-grade steel and has a special low-carbon surface and can be manufactured only at a comparatively high expense. The processing sequence often comprises 16 or more steps, which include about 5 steps for cleaning, about 4 steps for derusting (if there are indications of rust) and the remaining steps for forming a protective layer, inclusive of rinsing and neutralizing. Only thereafter is the enamel applied. The above-mentioned protective layer is often formed by immersing the workpieces in a nickel sulfate solution.

From British Patent Specification 755,559 it is known to form as a protective layer a phosphate layer usually consisting of a heavy metal phosphate and to convert at least a part of the phosphate by heating to an oxide before the vitreous enamel is applied. That process will not give good results and cannot be carried out in a simple manner and for this reason has not been successful.

From British Patent Specification 1,498,490 it is known to apply a nickel phosphate layer to prepare the metal surface before it is painted or enameled. But in that process the metal surface must be activated before it is contacted with the phosphating solution. The resulting nickel phosphate layers have a considerable weight. The adhesion of the subsequently applied vitreous enamel coating is not satisfactory even in that case. Similar difficulties or deficiencies occur in other known processes. Either their economy is only marginal because the pretreating process consists of a large number of steps or a satisfactory adhesion cannot be achieved unless at least two vitreous enamel coatings are applied in succession.

It is also known from DE-A-36 35 896 to prepare metal surfaces for the application of a vitreous enamel coating in that a phosphate layer is formed from a phosphating solution, which contains, e.g., 0.1 to 2 g/l nickel ions, 1 to 12 g/l phosphate ions, and nitrate ions and fluoride ions. The object of the last mentioned process is particularly to form a phosphate layer having a coating weight of 0.15 to 0.6 $g/m^2$.

Whereas the last outlined process represents a certain progress over those previously mentioned, it still has the disadvantage that, depending on the quality of the steel, the adhesion is not satisfactory particularly if only a single layer of the vitreous enamel is applied. It can be stated in general that phosphating processes have not been successful in practice for the preparation of metal surfaces for vitreous enameling.

It is an object of the present invention to provide a process for the preparation of metal surfaces for the application of a vitreous enamel coating so that a strong adhesion is obtained even if the vitreous enamel is deposited by a single coating operation. It is a further object to provide a process such that the adhesion is independent of the quality of the treated steel, and which process can be carried out economically and in a simple manner.

THE INVENTION

The above stated objects are obtained by a process of the invention wherein the metal surface is contacted with a phosphating solution which essentially contains nickel and/or cobalt in amounts of 0.5 to 3 g/l as a layer-forming cation and also contains:

5 to 20 g/l phosphate (calculated as $P_2O_5$);

0.1 to 0.5 g/l molybdate (calculated as $MoO_3$);

0.2 to 2 g/l fluoride (calculated as F); and 1 to 10 g/l nitrate (calculated as $NO_3$).

According to a preferred embodiment of the invention, the metal surface is contacted with a phosphating solution which contains:

1 to 2 g/l nickel and/or cobalt;

8 to 18 g/l phosphate;

0.2 to 0.3 g/l molybdate;

0.4 to 1 g/l fluoride; and 2 to 5 g/l nitrate.

In another preferred embodiment, the metal surface is contacted with a phosphating solution which additionally contains 0.1 to 5 g/l, and preferably 0.2 to 2 g/l, of urea. The urea content will insure the destruction of any nitrite which may have formed in the phosphating solution by an autocatalytic reaction.

It is particularly desirable to introduce the fluoride component into the phosphating solution as a simple fluoride or as a fluorosilicate.

For the adhesion of the subsequently applied vitreous enamel coating it will be desirable to contact the metal surfaces with a phosphating solution which is virtually free of zinc. This will preclude an evaporation of zinc, which otherwise could not reliably be avoided at the high temperatures of the vitreo for the vitreous enameling.

The phosphating treatment may be conducted by dipping or spraying. The treatment is preferably performed at temperatures in the range of from 40° to 80° C., and more preferably from 60° to 70° C. The duration of the phosphating treatment is desirably in the range of from 2 to 15 minutes, and preferably in the range of from 4 to 10 minutes.

According to a preferred embodiment of the invention, the metal surface is contacted with the phosphating solution so that the resulting phosphate layer has a coating weight of 1.0 to 2.0 $g/m^2$. A phosphate layer having such a coating weight will permit an optimum anchoring and adhesion of the vitreous enamel layer.

If the metal surface to be phosphated is contaminated, the phosphating treatment must be preceded by a cleaning, such as a conventional alkaline cleaning, and a subsequent rinse.

In dependence on the quality of the steel to be treated the metal surface must pickled, desirably with sulfuric acid. According to a desirable feature, the metal surfaces are to be pickled in such a way that 2 to 10 $g/m^2$ metal are removed. The phosphating treatment is usually followed by one or more rinsing steps.

Conventional vitreous enamel frits may be used for the final vitreous enameling. The vitreous enameling may be carried out in one step to form a single vitreous enamel layer or a plurality of vitreous enamel coatings, may be applied, which are fired in succession.

The process in accordance with the invention for the preparation of a metal surface for vitreous enameling distinguishes in that the number of treating steps can distinctly be decreased, the capacity can be increased, the residence time can be decreased, and the capital investment for the pretreating plant can be decreased.

It is also significant that the omission of the main pickling treatment and of the nickeling bath have the result that the amount of formed iron sulfate sludge is decreased to about one-fourth of the original amount. This reduction means a corresponding decrease of the considerable costs for the disposal of waste materials, particularly for dumping. Such advantages are obtained without adverse results, e.g., as regards the adhesion of the vitreous enamel.

The invention will be explained in more detail by way of the following example.

EXAMPLE

The process in accordance with the invention is carried out for the following treatment of sheet steel cover hoods for flow heaters in preparation for the succeeding substantive white vitreous enameling:

| Zone | Function | Temperature | Treating time | Treating agent |
|---|---|---|---|---|
| 1 | degreasing | 80–95° C. | 5 min. | strongly alkaline dip cleaner (50 g/l) 50% $Na_2SiO_3$ 25% NaOH 20% $Na_2CO_3$ 5% sodium dodecylbenzene sulfonate |
| 2 | degreasing | 80–95° C. | 5 min. | strongly alkaline dip cleaner (50 g/l) (as in zone 1) |
| 3 | degreasing | 75° C. | 5 min. | strongly alkaline dip cleaner (50 g/l) (as in zone 1) |
| 4 | degreasing | 65° C. | 5 min. | strongly alkaline dip cleaner (50 g/l) (as in zone 1) |
| 5 | rinsing | 40° C. | 5 min. | water |
| 6 | rinsing | 28° C. | 5 min. | water |
| 7 | pickling | 65° C. | 5 min. | sulfuric acid (25 g/l) (metal removal 5.6 g/m$^2$) |
| 8 | rinsing | 35° C. | 5 min. | water (pH adjusted to 2.5 by an addition of sulfuric acid) |
| 9 | rinsing | 28° C. | 90 sec. | water |
| 10 | phosphat-ing | 65° C. | 7.5 min. | phosphating solution: 14 g/l phosphate calculated as $P_2O_5$ 1.8 g/l nickel 0.25 g/l molybdate 0.7 g/l fluoride 2.3 g/l nitrate 1.2 g/l urea (coating weight 1.5 g/m$^2$) |
| 11 | rinsing | 30° C. | 5 min. | water |
| 12 | rinsing | 25° C. | 5 min. | water |
| 13 | pickling | 65° C. | 5 min. | sulfuric acid 40 g/l (metal removal 22 g/m$^2$) |
| 14 | rinsing | 30° C. | 5 min. | water (pH adjusted to 2 to 3 by an an addition of sulfuric acid) |
| 15 | rinsing | 25° C. | 5 min. | water |
| 16 | nickeling | 25° C. | 5 min. | nickel sulfate solution 20 g/l, pH adjusted to 2.5 with sulfuric acid |
| 17 | rinsing | 25° C. | 5 min. | water |
| 18 | rinsing | 25° C. | 5 min. | water |
| 19 | passivating | 25° C. | 5 min. | alkaline solution 14 g/l $NaHCO_3$ 4 g/l $Na_3PO_4$ |

The cover hoods ar subsequently dried in an oven and coated in the conventional manner with vitreous enamel (substantive white).

The firing resulted in satisfactory vitreous enamel layers, which were white, visually uniform and well-adhering.

The vitreous enamel layers have the same quality as those which have been formed by the processing sequence which is usual in practice and in which the above-mentioned zones 9 and 10 are omitted but the succeeding zones 14 to 19 stated hereinafter are provided:

It will be understood that the specification and examples are illustrative but not limitative of the present invention and that other embodiments within the spirit and scope of the invention will suggest themselves to those skilled in the art.

We claim:

1. A process for the preparation of a metal surface for a succeeding vitreous enameling by application of a phosphate coating by means of a phosphating solution containing layer-forming cations, comprising: contacting the metal surface with a phosphating solution consisting essentially of:

5 to 20 g/l phospate (calculated as $P_2O_5$);

0.1 to 0.5 g/l molybdate (calculated as $MoO_3$);

0.2 to 2 g/l fluoride (calculated as F);

1 to 10 g/l nitrate (calculated as $NO_3$); and a layer-forming cation selected from the group consisting of nickel and/or cobalt in an amount of 0.5 to 3 g/l.

2. The process of claim 1 wherein the metal surface is contacted with a phosphating solution having a nickel and/or cobalt content of 1 to 2 g/l and 8 to 18 g/l phosphate;

0.2 to 0.3 g/l molybdate;

0.4 to 1 g/l fluoride; and 2 to 5 g/l nitrate.

3. The process of claim 1 wherein the metal surface is contacted with a phosphating solution further containing 0.1 to 5 g/l, preferably 0.2 to 2 g/l, of urea.

4. The process of claim 1 wherein the metal surface is contacted with a phosphating solution wherein the fluoride is a simple fluoride and/or a fluorosilicate.

5. The process of claim 1 wherein the metal surface is contacted with a phosphating solution which is essentially free of zinc.

6. The process of claim 1 wherein the metal surface is contacted with the phosphating solution at 40° to 80° C., preferably at 60° to 70° C.

7. The process of claim 1 wherein the metal surface is contacted with the phosphating solution for 2 to 15 minutes, preferably 4 to 10 minutes.

8. The process of claim 1 wherein the metal surface is contacted with the phosphating solution so that the formed phosphate layer has a coating weight of 1.0 to 2.0 g/m$^2$.

9. The process of claim 1 wherein the metal surface is pickled in sulfuric acid prior to the contacting with the phosphating solution.

10. The process of claim 9 wherein the metal surface is pickled to remove 2 to 10 g/m$^2$ metal.

* * * * *